US008616843B2

(12) United States Patent
Shibata et al.

(10) Patent No.: US 8,616,843 B2
(45) Date of Patent: Dec. 31, 2013

(54) TURBO MACHINERY

(75) Inventors: Takanori Shibata, Hitachinaka (JP); Manabu Yagi, Tsuchiura (JP); Hideo Nishida, Kasumigaura (JP); Hiromi Kobayashi, Kasumigaura (JP); Masanori Tanaka, Tsuchiura (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 678 days.

(21) Appl. No.: 12/907,126

(22) Filed: Oct. 19, 2010

(65) Prior Publication Data

US 2011/0097203 A1 Apr. 28, 2011

(30) Foreign Application Priority Data

Oct. 22, 2009 (JP) ..... 2009-243228

(51) Int. Cl.
*F04D 29/44* (2006.01)

(52) U.S. Cl.
USPC ..... 415/211.2

(58) Field of Classification Search
USPC ..... 415/208.2, 211.1, 211.2
See application file for complete search history.

(56) References Cited

U.S. PATENT DOCUMENTS

| | | | | |
|---|---|---|---|---|
| 4,349,314 | A * | 9/1982 | Erwin | 415/181 |
| 4,877,370 | A * | 10/1989 | Nakagawa et al. | 415/148 |
| 6,155,779 | A * | 12/2000 | Watanabe et al. | 415/150 |
| 2002/0106278 | A1 * | 8/2002 | Koga | 415/211.2 |

FOREIGN PATENT DOCUMENTS

| | | |
|---|---|---|
| JP | 11-082389 | 3/1999 |

* cited by examiner

*Primary Examiner* — Ninh H Nguyen
(74) *Attorney, Agent, or Firm* — Antonelli, Terry, Stout & Kraus, LLP.

(57) ABSTRACT

Turbo machinery comprising an impeller and a diffuser positioned on a downstream side of the impeller that a channel wall surface of the diffuser is composed of a pair of a shroud side diffuser plate and a hub side diffuser plate which surface each other and a channel width is formed so as to be increased downstream, characterized in that guide vanes in a circular arc shape lower in height than the channel width are installed in a line of a plurality of vanes on both channel walls of the shroud side diffuser plate and hub side diffuser plate of the diffuser, and a total of vane heights of the two guide vanes at an outlet of the diffuser is set so as to be within a range from 30 to 70% of the channel width at the outlet of the diffuser.

9 Claims, 7 Drawing Sheets

TURBO MACHINERY

CLAIM OF PRIORITY

The present application claims priority from Japanese patent application JP 2009-243228 filed on Oct. 22, 2009, the content of which is hereby incorporated by reference into this application.

BACKGROUND OF THE INVENTION

1. Field of the Invention

The present invention relates to turbo machinery and more particularly to turbo machinery such as a centrifugal compressor or a centrifugal fan that maintains high performance and is suitable for a compressor with a small sized casing.

2. Description of Related Art

A centrifugal compressor which is one of the turbo machineries for compressing a fluid by a rotating impeller is conventionally used widely in various plants. Recently, due to energy problems and environmental problems, the life cycle cost including the running cost thereof is apt to be regarded as important and a compressor for realizing high efficiency in a wide operating range is required.

In consideration of an operation in a fixed rotational speed, the operating range of the compressor is defined as a region lying between the surge limit which is an operating limit on the low flow rate side and the choke limit which is an operating limit on the high flow rate side.

On the other hand, when the flow rate of the compressor is reduced to the surge limit or below, the flow is separated inside the compressor and the discharge pressure and flow rate become unstable, so that the compressor cannot be operated steadily.

Further, even if the discharge pressure of the compressor is lowered so as to realize a high flow rate equal to or higher than the choke limit, the flow reaches the sound velocity inside the compressor, thus the flow rate cannot be increased to the choke limit or higher.

Generally, in a turbo compressor or a turbo fan that is conventional turbo machinery, on the downstream side of the impeller, in order to convert the kinetic energy into pressure energy, a vaneless diffuser and a vaned diffuser are installed.

On the downstream side of the diffuser, a scroll casing for collecting the flow discharged from the diffusers or a return channel for leading the flow to the next stage is installed.

Further, as a diffuser of the conventional centrifugal compressor, a vaneless diffuser such that the channel wall surface is composed of a pair of opposite diffuser plates on the downstream side of the impeller and the channel width is fixed downstream is known. However, the centrifugal compressor using the vaneless diffuser has a defect that although the operating range is wide, the efficiency is low.

Further, a diffuser such that between the pair of diffuser plates, guide vanes that the height is fixed and is almost equal to the channel width are installed in a circular arc, the so-called vaned diffuser is known. The centrifugal compressor using the vaned diffuser has a defect that although the efficiency of the design flow rate point is high, the operating range is narrow.

Therefore, as an improved diffuser, for example, in Japanese Patent Laid-open No. Hei 11 (1999)-82389, a constitution is disclosed that the channel wall surface on the shroud side of the diffuser is inclined so as to make the channel width larger downstream and on both channel wall surfaces on the shroud side and hub side of the diffuser, guide vanes with a height formed within the range from 40 to 60% of the outlet width of the diffuser are installed.

In the constitution of the diffuser described in Japanese Patent Laid-open No. Hei 11 (1999)-82389, the channel width is formed so as to be enlarged downstream, so that the pressure gradient in the radial direction can be made larger than that of the vaneless diffuser with parallel walls and the guide vanes are attached onto the channel wall surfaces, so that even at the enlarged pressure gradient, a back flow on the channel wall surfaces can be prevented.

Patent Document 1: Japanese Patent Laid-open No. Hei 11 (1999)-82389

SUMMARY OF THE INVENTION

However, in the diffuser described in Japanese Patent Laid-open No. Hei 11 (1999)-82389, an appropriate angle for installing the guide vane on the channel wall surface to be enlarged is not disclosed, thus there are possibilities that only by installation of the guide vane, on the contrary, the performance of the diffuser may be deteriorated. Further, only by installation of the guide vane, the guide vane cannot sufficiently fulfill a function as vanes for preventing the back flow on the channel wall surface and there are possibilities that the operating range of the diffuser may be narrowed.

On the other hand, generally, as for the diffuser, for a cost reduction of the compressor, better pressure recovery in a smaller diameter is strongly required. When the conventional diffuser without or with a guide vane is designated to be made smaller by decreasing the outlet diameter of the diffuser, since the channel width of the diffuser is fixed, the flow rate at the outlet of the diffuser is increased. The loss of an element (for example, the scroll, return channel, etc.) on the downstream side of the diffuser is proportional to the kinetic energy (dynamic pressure) at the outlet of the diffuser, so that a problem arises that the loss of the element on the downstream side is increased and the efficiency of the compressor is lowered.

An object of the present invention is to provide turbo machinery for preventing a back flow in the diffuser, improving the flow uniformity of the diffuser in the width direction, ensuring a wide operating range of the diffuser, maintaining the efficiency of the compressor, and reducing the casing diameter of the machinery.

The turbo machinery of the present invention is turbo machinery comprising an impeller and a diffuser positioned on a downstream side of the impeller that a channel wall surface of the diffuser is composed of a pair of a shroud side diffuser plate and a hub side diffuser plate which surface each other and a channel width is formed so as to be increased downstream, characterized in that guide vanes in a circular arc shape lower in height than the channel width are installed in a line of a plurality of vanes on both channel walls of the shroud side diffuser plate and hub side diffuser plate of the diffuser, and a total of vane heights of the two guide vanes at an outlet of the diffuser is set so as to be within a range from 30 to 70% of the channel width at the outlet of the diffuser, and assuming an inclination angle of the channel wall surface of the shroud side diffuser plate in a radial direction as $\theta_s$, a vane inlet angle of the guide vane installed on the wall surface of the shroud side diffuser plate in a peripheral direction at the inlet as $\beta_{s,in}$, an inclination angle of the channel wall surface of the hub side diffuser plate in the radial direction as $\theta_h$, and a vane inlet angle of the guide vane installed on the wall surface of the hub side diffuser plate in the peripheral direction at the inlet $\beta_{h,in}$, respectively, said four angles conform to a following formula (1), $$\beta_{s\,in}-\beta_{h\,in}=K(\theta_s-\theta_h)_0 \quad (1)$$

and K of the formula (1) is set so as to conform to the relation of K<0.

According to the present invention, turbo machinery for preventing a back flow in the diffuser, improving the flow uniformity of the diffuser in the width direction, ensuring a wide operating range of the diffuser, maintaining the efficiency of the compressor, and reducing the casing diameter of the machinery can be realized.

DETAILED DESCRIPTION OF THE INVENTION

Embodiment 1

The centrifugal compressor which is turbo machinery of the first embodiment of the present invention will be explained in detail with reference to the accompanying drawings.

Figure 1:
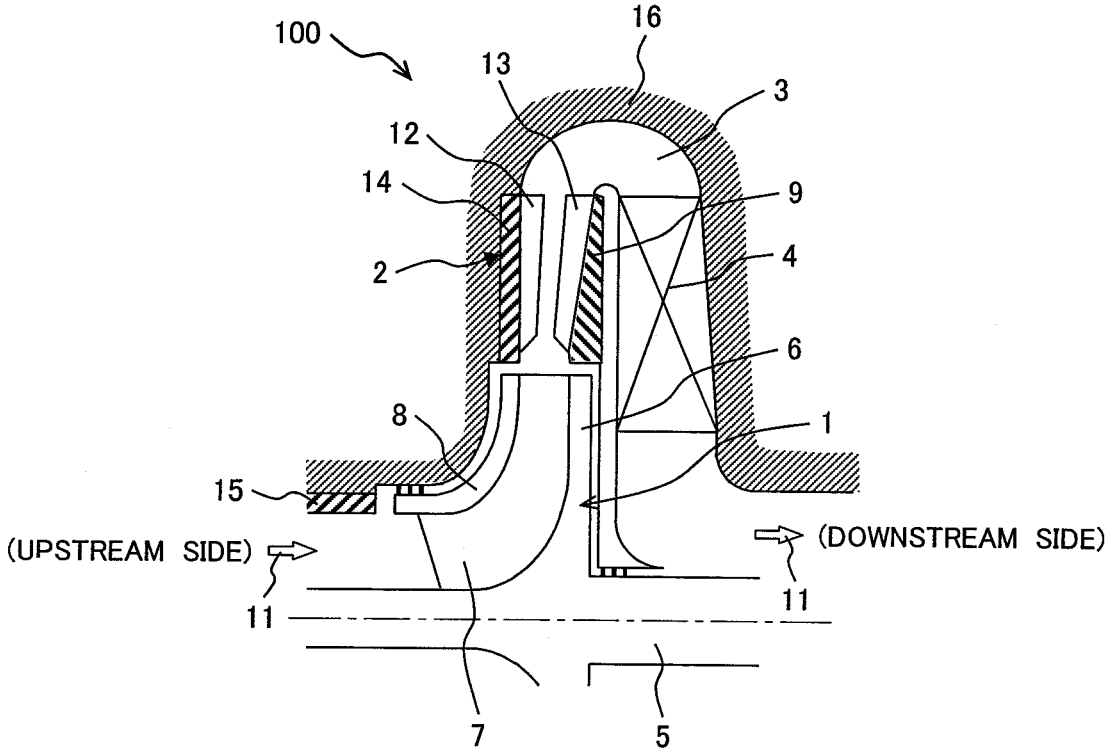
FIG. 1 is a cross sectional view showing the structure of the centrifugal compressor relating to the first embodiment of the present invention.
Figure 2:
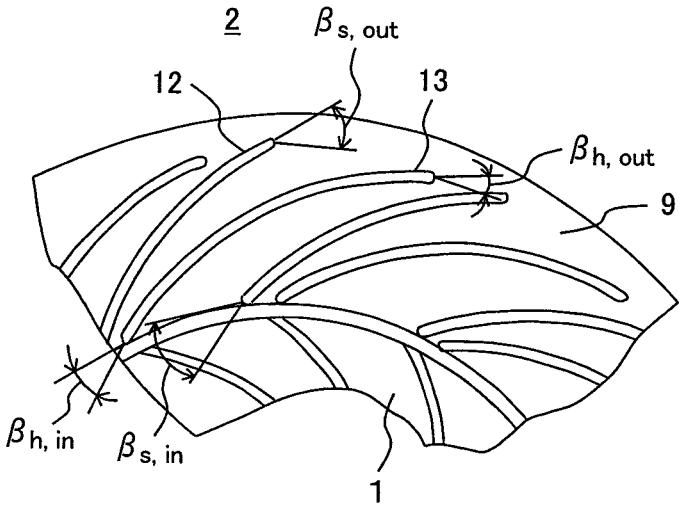
FIG. 2 is a cross sectional view showing the diffuser portion of the centrifugal compressor of the first embodiment shown in FIG. 1.

FIG. 1 is a cross sectional view showing the structure of a centrifugal compressor 100 relating to the first embodiment of the present invention and FIG. 2 shows the detailed vane of the diffuser of the centrifugal compressor 100 shown in FIG. 1.

As shown in FIG. 1, the centrifugal compressor 100 of this embodiment includes, in a casing 16, a rotary shaft 5 for driving rotation and an impeller 1 having a plurality of vanes 7 which are installed on the outer side of the rotary shaft 5, guide the flow of a working fluid 11 between a shroud 8 and a hub 6, and are arranged away from each other.

Inside the casing 16 and outside in the radial direction of the impeller 1 on the downstream side of the impeller 1, a diffuser 2 having vanes 12 and 13 is installed.

Inside the casing 16 on the downstream side of the diffuser 2, a return bend 3 and a return vane 4 for changing the direction of the flow of the working fluid 11 discharged from the diffuser 2 are installed.

On the inner wall of the casing 16 on the upstream side of the impeller 1, a suction duct 15 is installed.

The diffuser 2 includes a pair of a shroud side diffuser plate 14 and a hub side diffuser plate 9 which are opposite to each other for forming opposite channel wall surfaces so as to let the working fluid 11 flow down and furthermore, is composed of the vane 12 attached in a line of circular vanes onto the channel wall surface of the shroud side diffuser plate 14 and the vane 13 attached in a line of circular vanes onto the channel wall surface of the hub side diffuser plate 9.

The channel wall surface of the hub side diffuser plate 9 is formed with a gradient in the radial direction so as to enlarge the channel width of the diffuser 2 downstream.

Further, the total of the heights of the vane 12 in a circular arc shape attached onto the channel wall surface of the shroud side diffuser plate 14 and the vane 13 in a circular arc shape attached onto the channel wall surface of the hub side diffuser plate 9 is smaller than the channel width of the diffuser 2 and the vane height is formed so as to increase from the inlet to the outlet of the channel of the diffuser 2 that is downstream.

In the centrifugal compressor 100 of this embodiment shown in FIG. 1, the total of vane heights of the vanes 12 and 13 at the outlet of the diffuser 2 is equivalent to about 60% of the channel width at the outlet of the diffuser 2.

Figure 3:
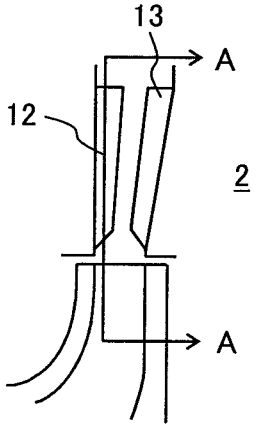
FIG. 3 is a cross sectional view in the radial direction showing the diffuser portion of the first embodiment shown in FIG. 2.

FIGS. 2 and 3 show the detailed diffuser portion 2 of the centrifugal compressor 100 of this embodiment shown in FIG. 1 and FIG. 3 is a view in the A-A direction shown in FIG. 2. In the diffuser portion 2 shown in FIGS. 2 and 3, the vane inlet angle measured in the tangential direction of the vane 12 installed on the shroud side diffuser plate 14 is referred to as $\beta_{s,\,in}$ and the vane outlet angle is referred to as $\beta_{s,\,out}$.

Similarly, the vane inlet angle measured in the tangential direction of the vane 13 installed on the hub side diffuser plate 9 is referred to as $\beta_{h,\,in}$ and the vane outlet angle is referred to as $\beta_{h,\,out}$.

In this case, the vane 12 installed on the shroud side diffuser plate 14 of the diffuser portion 2 and the vane 13 installed on the hub side diffuser plate 9 of this embodiment are set so as to make the vane inlet angle $\beta_{s,\,in}$ and vane outlet angle $\beta_{s,\,out}$ of the vane 12 respectively larger than the vane inlet angle $\beta_{h,\,in}$ and vane outlet angle $\beta_{h,\,out}$ of the vane 13 installed on the hub side diffuser plate 9.

Namely, the vane 12 of the shroud side diffuser plate 14 is installed in a stand-up form in the radial direction more than the vane 13 of the hub side diffuser plate 9.

Furthermore, for each of the vanes 12 and 13, the vane inlet angle $\beta_{s,\,in}$ and vane inlet angle $\beta_{h,\,in}$ are set so as to be respectively smaller than the vane outlet angle $\beta_{s,\,out}$ and vane outlet angle $\beta_{h,\,out}$.

Further, the leading edges of each of the plural vanes 12 and each of the plural vanes 13 are installed respectively in an aspect that the position in the peripheral direction is shifted in the very vicinity of the outlet of the impeller 1, for example, at the radial position 1 to 1.05 times of the tip diameter of the impeller 1.

If the centrifugal compressor 100 of this embodiment is operated, the working fluid 11 is sucked into the impeller 1 of the casing 16 through the suction duct 15, is given energy in the impeller 1 rotated by driving of the rotary shaft 5, and then is discharged from the impeller 1. The high-speed working fluid 11 discharged from the impeller 1 flows into the diffuser 2 installed in the casing 16 on the downstream side of the impeller 1.

The working fluid 11 is decelerated and is made more uniform by the diffuser 2, flows into the return bend 3 in the casing 16 positioned on the downstream side of the diffuser 2 and the return vane 4 positioned on the downstream side of the return bend 3, and then is discharged from the return vane 4.

Figure 4:
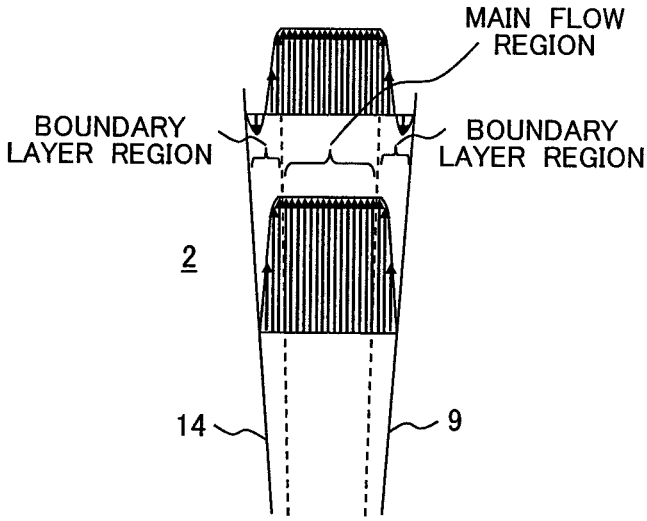
FIG. 4 is a drawing showing the flow rate on the meridian plane of the diffuser portion of the centrifugal compressor of the comparison example.
Figure 5:
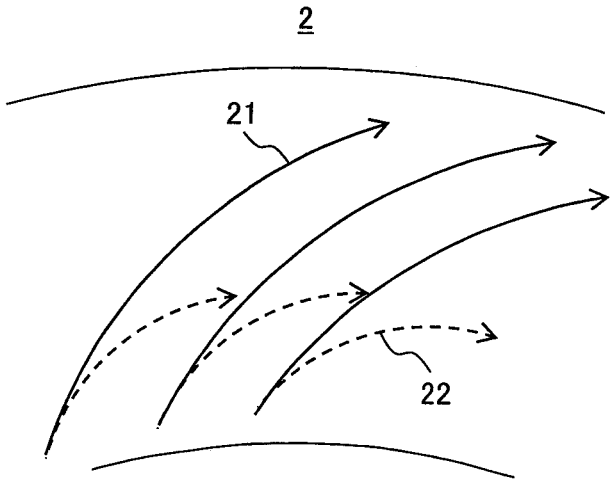
FIG. 5 is a drawing showing the streamlines on the meridian plane of the diffuser portion of the comparison example shown in FIG. 4.
Figure 6:
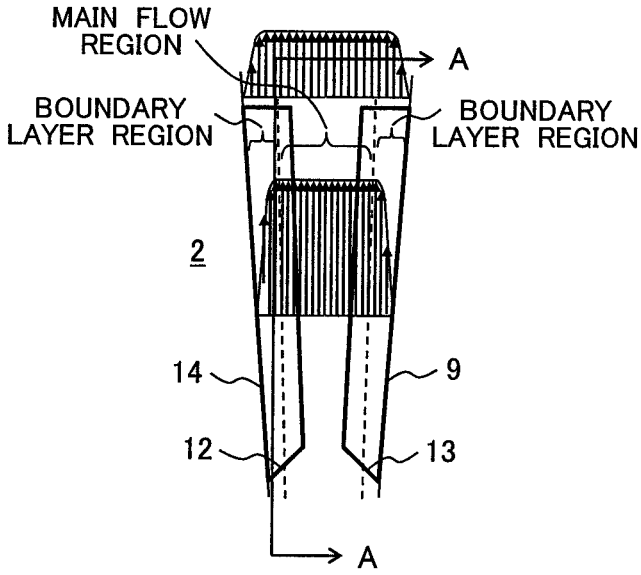
FIG. 6 is a drawing showing the flow rate on the meridian plane of the diffuser portion of the first embodiment shown in FIGS. 1 to 3.
Figure 7:
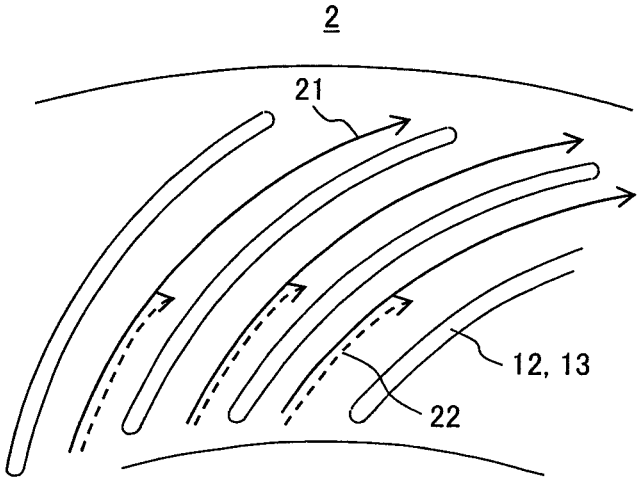
FIG. 7 is a drawing showing the streamlines on the meridian plane of the diffuser portion of the embodiment shown in FIG. 6.

The effects of the operation of the centrifugal compressor 100 of this embodiment, by referring to the constitution of the diffuser portion 2 of the centrifugal compressor 100 of this embodiment shown in FIGS. 6 and 7 and for comparison, by comparing it with the constitution of the diffuser 2 including no vane on the shroud side diffuser plate 14 and no hub side diffuser plate 9 of the diffuser portion 2 of the centrifugal compressor 100 of this embodiment which is the comparison example shown in FIGS. 4 and 5, will be explained below.

FIGS. 4 to 7 showing the respective diffusers 2 of the centrifugal compressor 100 show the channel form of the diffuser 2 installed on the downstream side of the impeller 1 of the centrifugal compressor 100 and the flow (the speed on the meridian plane) distribution of the working fluid flowing inside the diffuser 2 and the channel width of the diffuser 2 is structured so as to enlarge from the upstream side to the downstream side.

Among them, FIGS. 4 and 5 showing the diffuser 2 of the comparison example show the channel form of the diffuser 2 of the centrifugal compressor when the shroud side diffuser plate 14 and hub side diffuser plate 9 include no vane and the flow of the working fluid flowing inside the diffuser 2.

And, FIGS. 6 and 7 show the channel form of the diffuser 2, which is the diffuser 2 of this embodiment, of the centrifugal compressor 100 when the vane 12 is installed on the shroud side diffuser plate 14 and the vane 13 is installed on the hub side diffuser plate 9 and the flow of the working fluid flowing inside the diffuser 2.

Firstly, the principle of the effects of the operation produced by the centrifugal compressor 100 of this embodiment will be explained by using the diffuser 2 of the centrifugal compressor 100 shown in FIGS. 6 and 7 such that the wall surface of the shroud side diffuser plate 14 for forming the channel width of the diffuser and the wall surface of the hub side diffuser plate 9 are spread downstream almost symmetrically.

As shown in the diffuser 2 of this embodiment shown in FIGS. 6 and 7, the flow of the working fluid 11 flowing inside the diffuser 2 can be divided into the main flow region near the central portion of the channel of the diffuser 2 and the boundary layer regions near shroud and hub sides of the diffuser 2. Needless to say, the flow rate of the main flow region is larger than that of the boundary layer regions.

From the law of conservation of angular momentum, the peripheral speed of a main flow 21 of the working fluid 11 flowing in the main flow region at a high flow rate is decreased toward the outer side of the diffuser 2.

Further, from the law of conservation of mass, the radial speed of the main flow 21 of the working fluid 11 is decreased toward the outer side of the diffuser 2.

Due to these effects, the flow rate of the main flow 21 of the working fluid 11 flowing through the channel of the diffuser 2 is decreased toward the outer side of the diffuser 2 and in correspondence to it, the pressure of the working fluid 11 rises.

In the diffuser 2 of this embodiment shown in FIGS. 6 and 7 and the diffuser 2 of the comparison example shown in FIGS. 4 and 5, the streamlines of the main flow 21 of the working fluid 11 and the streamlines of a boundary layer flow 22 in the vicinity of both wall surfaces of the wall surface on the shroud side and the wall surface on the hub side of the diffuser 2 are shown.

As shown in FIG. 5, in the diffuser 2 of the comparison example, compared with the main flow 21 at a high flow rate, the boundary layer flow 22 at a low flow rate cannot overcome the pressure gradient of the main flow 21, and the flow rate in the radial direction is decreased more suddenly than the main flow 21, so that the streamlines of the boundary layer flow 22 become directed in the peripheral direction earlier than the streamlines of the main flow 21. And, as approaching the outlet of the diffuser 2, the radial speed of the boundary layer flow 22 is decreased remarkably and eventually, flow separation or back flow may occur (FIGS. 4 and 5).

Such a back flow occurs in the boundary layer region in the neighborhood of both wall surfaces of the wall surface on the shroud side diffuser plate 14 and the wall surface on the hub side diffuser plate 9 of the diffuser 2 and appears remarkably as the channel width of the diffuser 2 is enlarged suddenly.

Further, the back flow, regardless of the way to enlarge the channel width of the diffuser 2, occurs on the wall surface of the diffuser 2 which is the wall surface on the shroud side diffuser plate 14 and the wall surface on the hub side diffuser plate 9 of the diffuser 2 not including the vanes 12 and 13.

If the back flow occurs, the effective channel area of the diffuser 2 becomes smaller, so that the speed decrease of the diffuser 2 becomes smaller, and the pressure recovery rate of the main flow 21 is reduced, thus the performance of the diffuser 2 is deteriorated.

Further, the loss of an element (the return bend 3, return vane 4, etc.) on the downstream side of the diffuser 2 is proportional to the kinetic energy (dynamic pressure) at the outlet of the diffuser 2, so that the loss of the return bend 3 and return vane 4 is also increased. As a result, the performance of the centrifugal compressor is greatly lowered.

On the other hand, in the diffuser 2 of the centrifugal compressor 100 of this embodiment, as shown in FIGS. 3, 6, and 7, on the wall surfaces of the shroud side diffuser plate 14 and the hub side diffuser plate 9 where a back flow is apt to occur, a plurality of vanes 12 and 13 in a circular arc shape such that the height is lower than the channel width of the diffuser 2 and the vane height at the outlet of the diffuser 2 is about 60% of the channel width at the outlet are installed away from each other.

As shown in FIG. 7, in the diffuser 2 of this embodiment, the vanes 12 and 13 guide the boundary layer flow 22 in the neighborhood of the boundary layer so as to flow along the main flow 21, so that the separation of the boundary layer and back flow are avoided and the loss of the diffuser 2 can be reduced.

Furthermore, the back flow is prevented, thus in the vicinity of both wall surfaces of the wall surface of the shroud side diffuser plate 14 of the diffuser 2 and the wall surface of the hub side diffuser plate 9 of the diffuser 2, the fluid flows, so that the meridional speed of the main flow 21 flowing in the main flow region is decreased.

Therefore, the flow rate of the diffuser 2 at the outlet, compared with the case of the comparison example not including the vanes 12 and 13 shown in FIGS. 4 and 5, becomes greatly smaller, and the pressure of the fluid is increased in correspondence to it, so that it contributes to improvement of the performance of the centrifugal compressor 100.

Further, in the diffuser 2 of this embodiment, the speed reduction of the diffuser 2 is increased, so that the dynamic pressure of the diffuser 2 at the outlet becomes smaller, and the loss of the return bend 3 and return vane 4 is reduced, so that the performance of the centrifugal compressor is greatly improved.

Further, the diffuser realizes speed reduction without causing a back flow, so that as a result, the centrifugal compressor can be greatly reduced in casing diameter.

The diffuser 2 of this embodiment is structured so as to make the channel width wider downstream, so that the flow angle of the main flow 21 of the working fluid 11 is apt to be directed in the peripheral direction as approaching the outlet of the diffuser 2.

That is, the flow angle of the main flow at the outlet of the diffuser 2 becomes smaller than that of at the inlet.

The vane 12 in a circular arc shape installed on the shroud side diffuser plate 14 of the diffuser 2 of this embodiment and the vane 13 in a circular arc shape installed on the hub side diffuser plate 9 are set, for each vane, so that the vane inlet angles $\beta_{s,\ in}$ and $\beta_{h,\ in}$ respectively become smaller than the vane outlet angles $\beta_{s,\ out}$ and $\beta_{h,\ out}$.

Therefore, in accordance with the state of the main flow 21 of the working fluid 11, the flow in the boundary layer region can be made more uniform appropriately, and an increase in the loss of the main flow portion due to installation of the vanes is not caused, and the separation of the wall surface boundary layer and the back flow can be prevented. As a result, the performance of the centrifugal compressor 100 can be improved as mentioned above.

In the diffuser 2 of this embodiment, the leading edges of the vanes 12 and 13 are arranged in the vicinity of the outlet of the impeller 1 positioned on the upstream side of the diffuser 2, that is, the inlet portion of the diffuser 2, so that even if there is a boundary layer developed in the impeller 1, the back flow can be prevented appropriately from the inlet portion of the diffuser 2.

In the diffuser 2 of this embodiment, by use of the aforementioned constitution, the rapid turning of the boundary layer flow 22 which is caused by the diffuser of the comparison example shown in FIGS. 4 and 5 is suppressed, and the speed reduction in the diffuser 2 is increased, thus the pressure recovery can be improved.

Furthermore, in the diffuser 2 of this embodiment, the constitution that the vanes 12 and 13 are installed with the leading edges thereof shifted in the peripheral direction is used, so that the leading edges of the vanes 12 and 13 do not interfere simultaneously with the vanes 7 of the impeller 1, thus an effect of suppressing an occurrence of large noise is obtained.

In the diffuser 2 of this embodiment, the example that the vane heights of the vanes 12 and 13 at the outlet of the diffuser 2 of the vanes 12 and 13 are formed in about 60% of the channel width at the outlet of the diffuser 2 is explained above, though for the vanes 12 and 13 in a circular arc shape, if the vane heights at the outlet of the diffuser 2 are formed within the range from 30 to 70% of the channel width at the outlet of the diffuser 2, similar effects to the aforementioned are expected.

The vane heights of the vanes 12 and 13 must be higher than the boundary layer thickness developed on the wall surfaces of the hub side diffuser plate 9 of the diffuser 2 and the shroud side diffuser plate 14, though if the vane heights of the vanes 12 and 13 are increased excessively, an increase in the shock loss of the main flow 21 is caused, so that it is important to set a moderate vane height within the aforementioned range in accordance with the state of the flow.

According to this embodiment, turbo machinery for preventing the back flow in the diffuser, appropriately setting the vane inlet angle of the vane on the shroud side and the vane on the hub side, thereby improving the flow uniformity of the diffuser in the width direction, ensuring a wide operating range of the diffuser, thereby maintaining the efficiency of the compressor, and reducing the casing diameter of the machinery can be realized.

Embodiment 2

Next, the diffuser 2 of the centrifugal compressor 100 of the second embodiment of the present invention will be explained.

The diffuser 2 of the centrifugal compressor 100 of this embodiment is similar to the diffuser 2 of the centrifugal compressor 100 of the first embodiment explained previously in the basic constitution, so that the explanation of the common portions of the constitution of the two is omitted and only the different portions will be explained below.

FIGS. 8 to 11 showing each of the diffusers 2 of the centrifugal compressor 100 show the channel form of the diffuser 2 installed on the downstream side of the impeller 1 of the centrifugal compressor 100 and the flow (the speed on the meridian plane) distribution of the working fluid flowing inside the diffuser 2, showing a constitution that the channel width of the diffuser 2 is enlarged from the upstream side to the downstream side.

Figure 8:
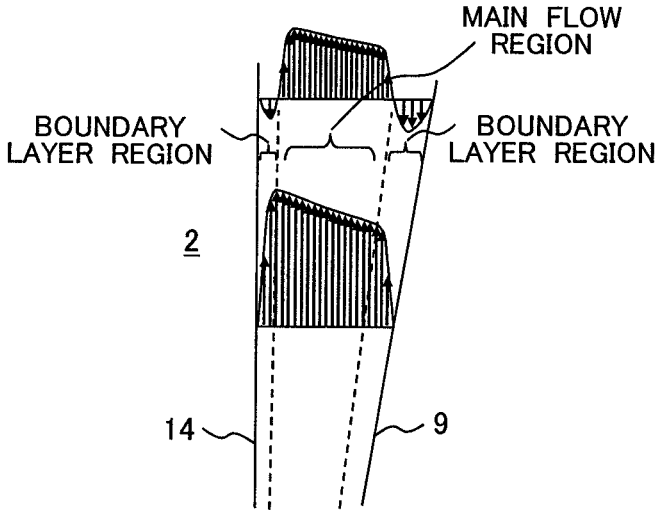
FIG. 8 is a drawing showing the flow rate on the meridian plane of the diffuser portion of the centrifugal compressor of another comparison example.
Figure 9:
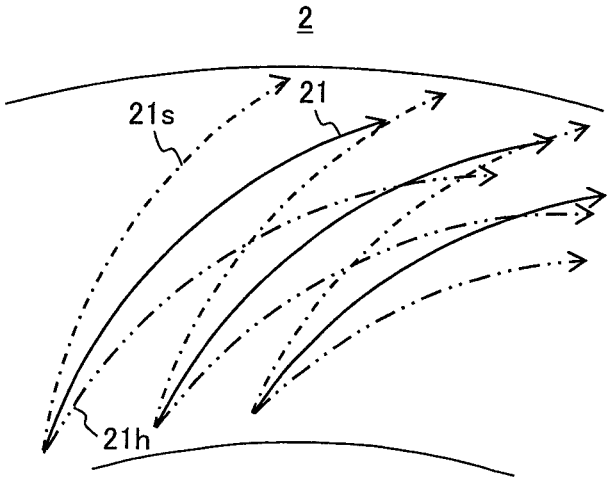
FIG. 9 is a drawing showing the streamlines on the meridian plane of the diffuser portion of the comparison example shown in FIG. 8.
Figure 10:
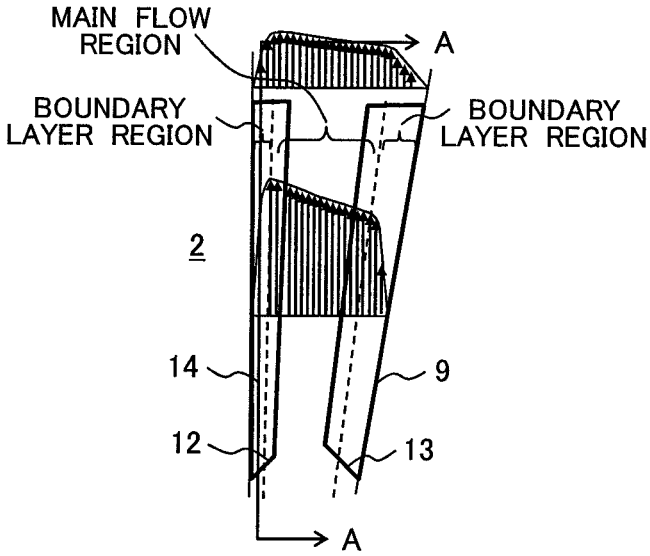
FIG. 10 is a drawing showing the flow rate on the meridian plane of the diffuser portion of the centrifugal compressor relating to the second embodiment of the present invention.
Figure 11:
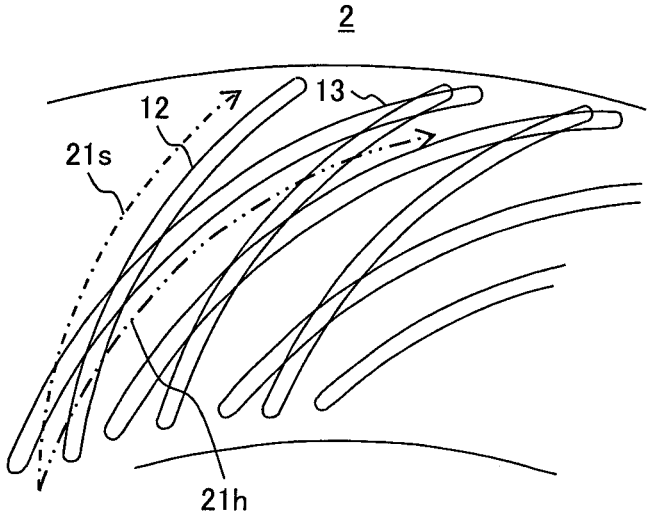
FIG. 11 is a drawing showing the streamlines on the meridian plane of the diffuser portion of the second embodiment shown in FIG. 10.

Among them, FIGS. 10 and 11 showing the diffuser 2 of this embodiment and FIGS. 8 and 9 showing the diffuser 2 of the comparison example show the channel form of the diffuser 2 when the shroud side diffuser plate 14 and hub side diffuser plate 9 are inclined and formed asymmetrically in the radial direction and the flow of the working fluid flowing inside the diffuser 2.

Namely, the shroud side diffuser plate 14 is arranged as a wall surface not inclined in the radial direction, while the wall surface of the hub side diffuser plate 9 opposite to the shroud side diffuser plate 14 is formed as a wall surface inclined in the radial direction.

Furthermore, FIGS. 8 and 9 showing the diffuser 2 of the comparison example show the channel form of the diffuser 2 of the centrifugal compressor when the shroud side diffuser plate 14 and hub side diffuser plate 9 include no vanes and the flow of the working fluid flowing inside the diffuser 2.

And, FIGS. 10 and 11 show the channel form of the diffuser 2, which is the diffuser 2 of this embodiment, of the centrifugal compressor 100 when the vane 12 is installed on the shroud side diffuser plate 14 and the vane 13 is installed on the hub side diffuser plate 9 and the flow of the working fluid flowing inside the diffuser 2.

Even when the vanes 12 and 13 are installed respectively on the wall surfaces of the shroud side diffuser plate 14 and hub side diffuser plate 9 composing the diffuser 2 of the centrifugal compressor 100 of this embodiment which are inclined asymmetrically, the effects of the operation by the diffuser 2 are basically similar in principle to those of the diffuser 2 shown in FIGS. 4 to 7 which are explained previously.

However, in the diffuser 2 of the centrifugal compressor 100 of this embodiment, to sufficiently extract the effects of the vanes 12 and 13 arranged on the wall surfaces of the shroud side diffuser plate 14 and hub side diffuser plate 9, idea in consideration that the inclinations of the wall surfaces of the shroud side diffuser plate 14 and hub side diffuser plate 9 are formed asymmetrically is required further more.

Namely, when the wall surfaces of the shroud side diffuser plate 14 and hub side diffuser plate 9 are inclined asymmetrically in the radial direction, as shown in the comparison example shown in FIGS. 8 and 9, among the main flow 21 of the working fluid 11 flowing in the diffuser 2, a main flow 21*h* on the close side to the wall surface of the hub side diffuser plate 9 which is largely inclined is largely decreased in the flow rate on the meridian plane and a main flow 21*s* on the close side to the wall surface of the shroud side diffuser plate 14 which is inclined by a small amount is decreased by a small amount in the flow rate on the meridian plane.

In other words, the average streamlines of the main flow 21, on the close side to the wall surface of the shroud side diffuser plate 14, become streamlines standing in the radial direction like the streamlines 21*s* and the streamlines 21*h* on the close side to the wall surface of the hub side diffuser plate 9 become streamlines turned sideways in the peripheral direction.

Therefore, as shown in the comparison example shown in FIGS. 8 and 9, in the diffuser 2 using a constitution that no vanes are installed on the wall surfaces of the shroud side diffuser plate 14 and hub side diffuser plate 9, the boundary layer flow 22 in the vicinity of the wall surfaces of the shroud side diffuser plate 14 and hub side diffuser plate 9 is separated without withstanding the pressure gradient of the main flows 21*s* and 21*h*, causing a back flow.

To prevent the flow separation, as described in the above comparison example, of the boundary layer flow 22 flowing in the boundary layer in the vicinity of the wall surfaces of the diffuser 2 and the back flow, it is effective to install vanes on the wall surfaces of the shroud side diffuser plate 14 and hub side diffuser plate 9 and control the flow inside the boundary layer to a flow along the main flow.

However, when the wall surfaces of the diffuser 2 are inclined and formed asymmetrically, as mentioned above, the main flow is changed in the height direction of the diffuser 2, so that installation of vanes in accordance with the state of the flow is important.

Therefore, to realize installation of appropriate vanes, in the diffuser 2 of the centrifugal compressor 100 of the second embodiment of the present invention, as shown in FIGS. 10 and 11, the vane inlet angle of the vane 12 in a circular arc shape installed on the wall surface of the shroud side diffuser plate 14 inclined by a small amount, compared with the vane inlet angle of the vane 13 in a circular arc shape installed on the wall surface of the hub side diffuser plate 9 largely inclined, is set as an angle standing in the radial direction.

Namely, the vane 12, so as to flow along the streamlines of the main flow 21*s* on the close side to the wall surface of the shroud side diffuser plate 14 and the vane 13, so as to flow along the streamlines of the main flow 21*h* on the close side to the wall surface of the hub side diffuser plate 9, are installed with the respective vane inlet angles changed.

As mentioned above, in the diffuser 2 of this embodiment of the present invention, the vane inlet angle $\beta_{s,\,in}$ of the vane 12 is set so as to be larger than the vane inlet angle $\beta_{h,\,in}$ of the vane 13, so that the vanes 12 and 13 can be installed respectively in the flow along the streamlines of the main flows 21*s* and 21*h*. As a result, the separation of the boundary layer flow 22 in the vicinity of the wall surfaces of the shroud side diffuser plate 14 and hub side diffuser plate 9 is prevented and simultaneously, an occurrence of a loss due to the inconsistency of the flow angles of the main flows 21*s* and 21*h* with the arrangement angles of the vanes 12 and 13 can be prevented.

Figure 12:
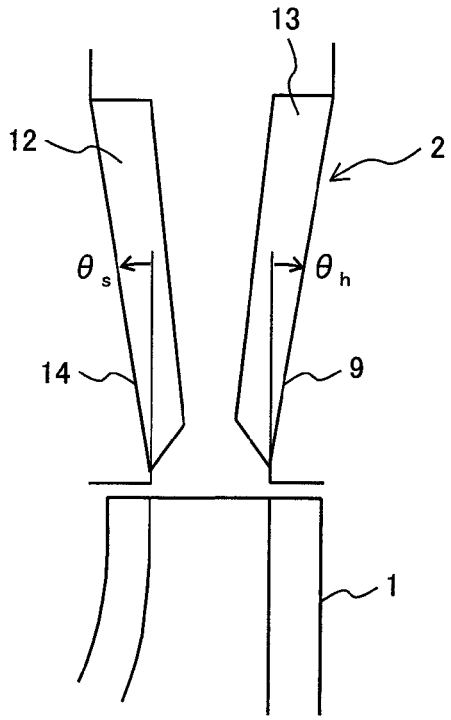
FIG. 12 is a conceptual diagram showing the inclination angle of the diffuser wall surface and the vane inlet angle of the guide vane of the diffuser portion of the second embodiment shown in FIG. 10.
Figure 13:
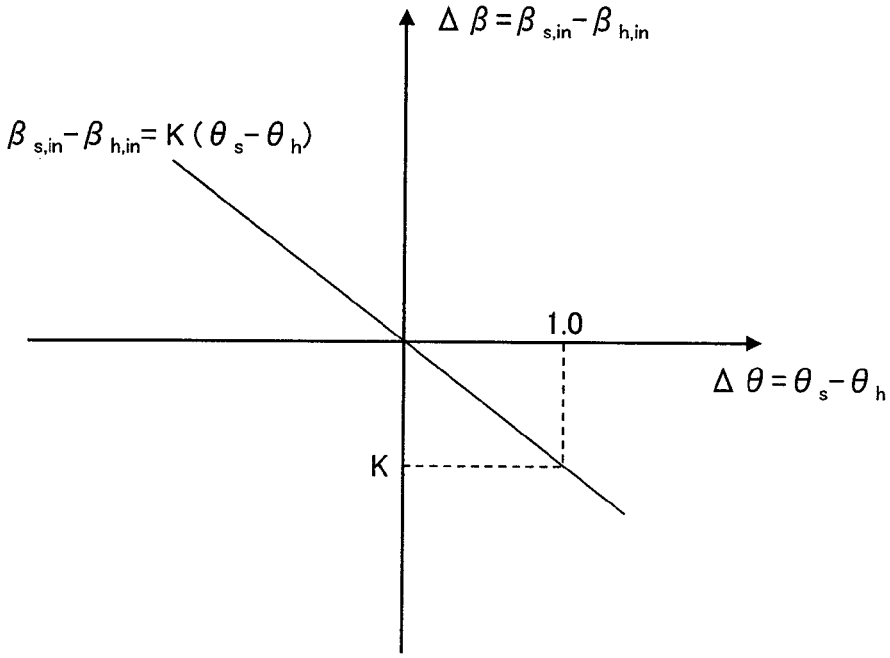
FIG. 13 is a relation diagram showing the relation between the inclination angle of the diffuser wall surface and the vane inlet angle of the guide vane of the diffuser portion of the second embodiment shown in FIG. 10.

The relation of the vanes 12 and 13 arranged on the wall surfaces of the shroud side diffuser plate 14 and hub side diffuser plate 9 composing the diffuser 2 of the centrifugal compressor 100 of this embodiment to the inclination state of each wall surface of the shroud side diffuser plate 14 and hub side diffuser plate 9 is shown in FIGS. 12 and 13.

FIG. 12 is a conceptual diagram showing the inclination angle of the diffuser wall surface and the vane inlet angles of the vanes of this embodiment, and FIG. 13 is a relation diagram showing the relation between the inclination angle of the diffuser wall surface and the vane inlet angles of the vanes of this embodiment, and $\theta_s$ indicates an inclination angle of the shroud side diffuser plate 14 inclined in the radial direction on the wall surface of the shroud side diffuser plate 14 close to the shroud side of the impeller 1, and $\theta_h$ indicates an inclination angle of the hub side diffuser plate 9 inclined in the radial direction on the wall surface of the hub side diffuser plate 9 close to the hub side of the impeller 1. However, the inclination angle $\theta_s$ of the shroud side diffuser plate 14 and the inclination angle $\theta_h$ of the hub side diffuser plate 9 are displayed assuming the direction that each diffuser plate inclines in the spreading direction of the channel width of the diffuser 2 as positive.

The vanes 12 and 13 respectively arranged on the wall surfaces of the shroud side diffuser plate 14 and hub side diffuser plate 9 composing the diffuser 2 of this embodiment are related so that the vane inlet angle $\beta_{s,\,in}$ of the vane 12 and the vane inlet angle $\beta_{h,\,in}$ of the vane 13 conform to the relation of Formula (1).

$$\beta_{s\,in}-\beta_{h\,in}=K(\theta_s-\theta_h)_0 \tag{1}$$

Here, K is a constant to be set in accordance with the flow state at the outlet of the impeller 1 and takes a value of $K<0$. More restrictively, in the flow of a standard centrifugal compressor, K takes a value of $-2<K<0$.

Formula (1) indicated above means that as the asymmetry of the inclination angle $\theta_s$ of the wall surface of the shroud side diffuser plate 14 composing the diffuser 2 to the inclination angle $\theta_h$ of the wall surface of the hub side diffuser plate 9 is increased, a large difference appears between the vane inlet angle $\beta_{s,\,in}$ of the vane 12 and the vane inlet angle $\beta_{h,\,in}$ of the vane 13.

It corresponds to a physical change that as the asymmetry of the inclination angle $\theta_s$ of the wall surface of the shroud side diffuser plate 14 to the inclination angle $\theta_h$ of the wall surface of the hub side diffuser plate 9 is increased, in the width direction at the inlet of the diffuser 2, non-uniformity of the flow is induced.

To set a total value $\theta_s+\theta_h$ of the inclination angle $\theta_s$ of the wall surface of the shroud side diffuser plate 14 and the inclination angle $\theta_h$ of the wall surface of the hub side diffuser plate 9 to a value within the range from 6° to 12° is appropriate to maximize the pressure recovery on the wall surfaces of the diffuser 2 and particularly, setting the total value $\theta_s+\theta_h$ of inclination angles to 8° or so is desirable from the viewpoint of the balance between the pressure recovery rate and the operating range.

Further, if the total value $\theta_s+\theta_h$ of inclination angles is made larger than 12°, the flow is apt to be separated on the wall surfaces of the diffuser 2 and in relation to the enlargement of the channel width of the diffuser 2, the effect of blockage due to the separation of the boundary layer flow in the neighborhood of the wall surfaces of the diffuser 2 is large and a practical channel enlargement effect is not produced.

Further, if the total value $\theta_s+\theta_h$ of inclination angles is made smaller than 6°, the enlargement rate of the wall surfaces of the diffuser 2 is low and the effect of the pressure recovery of the diffuser 2 is small.

On the other hand, when the total value $\theta_s+\theta_h$ of inclination angles is set to 8° or so, the pressure recovery rate by the diffuser 2 is high and for a flow within a wide flow-in angle range, the boundary layer flow in the vicinity of the wall surfaces of the diffuser 2 is hardly separated and as a result, a diffuser 2 of high efficiency within a wide operating range can be easily realized.

When the outlet flow of the impeller 1 of the centrifugal compressor is supposed to be uniform, the inlet flow of the diffuser 2 has a property that as the asymmetry of the inclination angle $\theta_s$ of the wall surface of the shroud side diffuser plate 14 of the diffuser 2 to the inclination angle $\theta_h$ of the wall surface of the hub side diffuser plate 9 is increased, the non-uniformity of the diffuser 2 in the width direction is increased.

When the total value $\theta_s+\theta_h$ of inclination angles is within the range from 6° to 12°, it is ascertained from the analysis of the flow that a difference $\Delta\beta$ ($\Delta\beta=\beta_{s,\,in}-\beta_{h,\,in}$) between the vane inlet angle $\beta_{s,\,in}$ of the vane 12 and the vane inlet angle $\beta_{h,\,in}$ of the vane 13 at the inlet of the diffuser 2 is nearly similar to the absolute value of an inclination angle difference $\theta_s-\theta_h$ between the inclination angle $\theta_s$ of the wall surface of the shroud side diffuser plate 14 of the diffuser 2 and the inclination angle $\theta_h$ of the wall surface of the hub side diffuser plate 9 and to set K of Formula (I) to −1 or so and set respectively the vane inlet angle $\beta_{s,\,in}$ of the vane 12 of the diffuser 2 and the vane inlet angle $\beta_{h,\,in}$ of the vane 13 is valid for structuring a diffuser 2 of high efficiency within a wide operating range.

Under the influence of the inner flow of the impeller 1, as for the flow at the outlet of the impeller 1, generally, the flow on the shroud 8 is apt to be slow and the flow on the hub 6 is apt to be fast. In this case, particularly, by setting the inclination angle $\theta_s$ of the wall surface of the shroud side diffuser plate 14 of the diffuser 2 as $\theta_s=0$ and the inclination angle $\theta_h$ of the wall surface of the hub side diffuser plate 9 as $\theta_h=8°$, an effect of bringing a drift generated by the impeller 1 to uniformity is obtained.

The non-uniformity of the flow at the outlet of the impeller 1 is cancelled by making the inclination angle $\theta_s$ of the wall surface of the shroud side diffuser plate 14 of the diffuser 2 and the inclination angle $\theta_h$ of the wall surface of the hub side diffuser plate 9 an asymmetrical inclination, thus the flow approaches uniformity, so that there is no need to increase the difference between the vane inlet angle $\beta_{s,\,in}$ of the vane 12 and the vane inlet angle $\beta_{h,\,in}$ of the vane 13 at the inlet of the diffuser 2 by so much.

Therefore, when the non-uniformity at the outlet of the impeller 1 is strong, K is set as $-1<K<0$ and the vanes 12 and 13 of the diffuser 2 are installed, thus a diffuser 2 of high efficiency in a wide operating range can be structured.

Further, in the diffuser 2 when the inclination angle $\theta_s$ of the wall surface of the shroud side diffuser plate 14 of the diffuser 2 and the inclination angle $\theta_h$ of the wall surface of the hub side diffuser plate 9 are set as $\theta_s=0$ or $\theta_h=0$, the vane 12 is installed on the wall surface of the shroud side diffuser plate 14 on a plane free of inclination or the vane 13 is installed on the wall surface of the hub side diffuser plate 9 on a plane free of inclination, thus compared with the case that the vane 12 or 13 is installed on the wall surface on a circular cone at an inclination angle $\theta_s\neq0$ or an inclination angle $\theta_h\neq0$, the structure becomes simple and the manufacturing cost can be reduced.

When manufacturing the vanes 12 and 13 respectively by machining the wall surface of the shroud side diffuser plate 14 and the wall surface of the hub side diffuser plate 9 composing the diffuser 2, if the wall surface of the shroud side diffuser plate 14 and the wall surface of the hub side diffuser plate 9 composing the diffuser 2 are a plane, the vanes 12 and 13 can be processed by a 2-axis machining center, though when the wall surfaces of the diffuser 2 are a circular cone, the vanes 12 and 13 cannot be machined by other than a five-axis machining center.

Therefore, an exceptional difference appears in the machining cost. Further, when separately manufacturing the vanes 12 and 13, joining them to the wall surface of the shroud side diffuser plate 14 and the wall surface of the hub side diffuser plate 9 by welding, thereby manufacturing the diffuser 2, in welding and joining the vanes 12 and 13 to the wall surface of the shroud side diffuser plate 14 and the wall surface of the hub side diffuser plate 9 which are formed in a circular cone shape, the positioning and adhesion of the vanes 12 and 13 are difficult and compared with the aforementioned welding to the wall surfaces formed in a plane shape, the manufacturing cost is greatly increased.

Furthermore, when arranging the vane 12 or 13 on the aforementioned wall surface formed in a plane shape, if the shape of the vanes 12 and 13 is set particularly to a shape composed of line elements perpendicular to the plane, the vane shape of the vanes 12 and 13 can be machined by line cutting instead of point cutting, so that the machining time can be shortened and the machining cost can be decreased.

Further, if the vane shape of the vanes 12 and 13 is composed of a simple circular arc, a program input to an NC machining center can be simplified and it can contribute to reduction in the manufacturing cost.

Further, the aforementioned centrifugal compressor 100 of this embodiment uses a constitution that the impeller 1 including the shroud 8 and hub 6 on the upstream side of the diffuser 2 is installed and the principle and effects of the operation of the diffuser 2 are explained, though even if the impeller 1 is formed in an open shape that the shroud 8 and hub 6 are not installed, similar operation effects can be expected for the diffuser 2.

According to this embodiment, turbo machinery for preventing a back flow in the diffuser, improving the flow uniformity of the diffuser in the width direction by appropriately setting the vane inlet angles of the vane on the shroud side and the vane on the hub side, ensuring a wide operating range of the diffuser, maintaining the efficiency of the compressor, and reducing the casing diameter of the machinery can be realized.

The present invention is applicable to turbo machinery such as a centrifugal compressor or a centrifugal fan that maintains high performance and is suitable for a compressor with a small sized casing.

What is claimed is:

1. Turbo machinery comprising an impeller and a diffuser positioned on a downstream side of the impeller, a channel wall surface of the diffuser being composed of a pair of a shroud side diffuser plate and a hub side diffuser plate which surface each other and a channel width is formed so as to be increased downstream, characterized in that guide vanes in a circular arc shape lower in height than the channel width are installed in a line of a plurality of vanes on both channel walls of the shroud side diffuser plate and hub side diffuser plate of the diffuser, and a total of vane heights of the two guide vanes at an outlet of the diffuser is set so as to be within a range from 30 to 70% of the channel width at the outlet of the diffuser, and assuming an inclination angle of the channel wall surface of the shroud side diffuser plate in a radial direction as $\theta_s$, a vane inlet angle of the guide vane installed on the wall surface of the shroud side diffuser plate in a peripheral direction at the inlet as $\beta_{s,in}$, an inclination angle of the channel wall surface of the hub side diffuser plate in the radial direction as $\theta_h$, and a vane inlet angle of the guide vane installed on the wall surface of the hub side diffuser plate in the peripheral direction at the inlet $\beta_{h,in}$, respectively, said four angles set conform to a following formula (1), $$\beta_{s\,in}-\beta_{h\,in}=K(\theta_s-\theta_h)_0 \quad (1)$$

and K of the formula (1) is set so as to conform to a relation of $K<0$.

2. The turbo machinery according to claim 1, wherein K is set as $1\leq|K|\leq 2$.

3. The turbo machinery according to claim 1, wherein a vane outlet angle of a vane angle measured in the peripheral direction of the vane installed in the diffuser is structured so as to be smaller than a vane inlet angle.

4. The turbo machinery according to claim 1, wherein the machinery is structured so as to conform to $6\leq\theta_s+\theta_h\leq 12$.

5. The turbo machinery according to claim 1, wherein the machinery is structured so as to conform to the inclination angle $\theta_s=0$ or the inclination angle $\theta_h=0$.

6. The turbo machinery according to claim 1, wherein a shape of the vanes is formed so as to be perpendicular to the wall surfaces of the shroud side diffuser plate and the hub side diffuser plate.

7. The turbo machinery according to claim 1, wherein a leading edge of the vane installed on the wall surface of the shroud side diffuser plate and a leading edge of the vane installed on the wall surface of the hub side diffuser plate are arranged by shifting their positions in the peripheral direction.

8. The turbo machinery according to claim 1, wherein a leading edge of the vane installed on the wall surface of the shroud side diffuser plate and a leading edge of the vane installed on the wall surface of the hub side diffuser plate are positioned inside by 1.05 times of an tip diameter of the impeller on an inner peripheral side.

9. The turbo machinery according to claim 1, wherein a camber line of the vane is composed of a circular arc.

* * * * *